United States Patent [19]

Verhaeghe et al.

[11] Patent Number: 4,936,358

[45] Date of Patent: Jun. 26, 1990

[54] METHOD FOR SECURING WIRE COILED ONTO A SPOOL, APPARATUS FOR SECURING WIRE COILED ONTO A SPOOL, AS WELL AS SPOOL CONTAINING WIRE COILED THEREON

[75] Inventors: John Verhaeghe, Deerlijk; Jozef Wyckhuys, Meulebeke; Etienne Lambert, Harelbeke, all of Belgium

[73] Assignee: N.V. Bekaert S.A., Zwevegem, Belgium

[21] Appl. No.: 205,948

[22] Filed: Jun. 13, 1988

[30] Foreign Application Priority Data

Jul. 16, 1987 [NL] Netherlands ..... 8701685

[51] Int. Cl.[5] ..... B21F 15/04; B65H 54/02

[52] U.S. Cl. ..... 140/149; 242/25 R

[58] Field of Search ..... 242/25 R, 125, 125.1, 242/125.2; 140/102, 149; 289/12, 18; 279/43, 37, 50; 81/9.51; 53/116

[56] References Cited

U.S. PATENT DOCUMENTS

| | | | |
|---|---|---|---|
| 1,760,969 | 8/1988 | Otoshima et al. | 242/18 R |
| 2,394,807 | 5/1944 | Robinson | 140/149 X |
| 2,775,266 | 12/1956 | Fick et al. | 140/115 |
| 3,420,280 | 1/1969 | Allyn | 140/149 |
| 3,838,715 | 10/1974 | Lang et al. | 140/149 |
| 4,160,469 | 7/1979 | Joannic | 140/119 X |
| 4,292,114 | 10/1981 | Engmann et al. | 242/25 R X |

FOREIGN PATENT DOCUMENTS

| | | | |
|---|---|---|---|
| 2453716 | 6/1975 | Fed. Rep. of Germany . | |
| 217490 | 1/1985 | Fed. Rep. of Germany | 242/25 R |
| 2381664 | 9/1978 | France | 140/119 X |
| 162469 | 7/1986 | Japan . | |
| 2027076 | 2/1980 | United Kingdom | 242/25 R X |
| 2193128 | 2/1988 | United Kingdom | 140/149 |

*Primary Examiner*—Stuart S. Levy
*Assistant Examiner*—William G. Battista, Jr.
*Attorney, Agent, or Firm*—Shlesinger & Myers

[57] ABSTRACT

The invention relates to a method for securing the end of wire coiled onto a spool, whereby the last winding of the wire coiled onto the spool is taken up together with at least one preceding winding and connected thereto, after which the wire is cut between the connection thus made and the wire feed apparatus, whereby the length of the windings to be connected to each other is increased under tension and the additional length of wire is concentrated where the connection is to be formed, that the additional length of the windings to be connected to each other is held under tension, and that during the connection operation the additional, free length of wire of the windings to be connected to each other is incorporated in the connection thus formed.

20 Claims, 4 Drawing Sheets

METHOD FOR SECURING WIRE COILED ONTO A SPOOL, APPARATUS FOR SECURING WIRE COILED ONTO A SPOOL, AS WELL AS SPOOL CONTAINING WIRE COILED THEREON

FIELD OF THE INVENTION

The invention relates first of all to a method for securing the end of wire coiled onto a spool, whereby the last winding of the wire coiled onto the spool is taken up together with at least one preceding winding and connected thereto, after which the wire is cut between the connection thus made and the wire feed apparatus.

BACKGROUND OF THE INVENTION

Such a method is well known. In order to secure or to connect a wire end to a preceding winding, the aforementioned wire end and the preceding winding are gripped together with a pair of pliers, the latter then being rotated so as to twist both wires around each other, thus connecting or attaching them to each other.

Such a method is usually carried out manually, and has the disadvantage that the connection thus formed cannot be made in a reproducible manner and that varying lengths of wire become unsuitable for future use, depending on the skill of the, operator.

OBJECTS AND SUMMARY OF THE INVENTION

It is an object of the present invention to provide a solution for the above-mentioned problem, permitting a reproducible way of operation amendable to mechanisation and automation.

The present invention is therefore characterized in that the length of the windings to be connected to each other is increased under tension and the additional length of wire is concentrated where the connection is to be formed, that the additional length of the windings to be connected to each other is held under tension, and that during the connection operation the additional, free length of wire of the windings to be connected to each other is incorporated in the connection thus formed.

A high degree of reproducibility is obtained by first of all elongating the windings to be connected to each other and by concentrating in this way the additional length (in comparison with the original length, whereby the windings lie side by side against each other) in one specific location, by keeping under tension this additional length of the windings to be connected to each other and by finally taking up this additional length into this connection, because the aforementioned elongation, the holding under tension and the connection of the windings are all executed while the wire is held under its normal winding tension.

In particular, the additional length of the windings to be connected to each other is, according to the method of the invention, kept under tension along a fixed distance downstream and upstream of the connection to be formed.

The invention also relates to an apparatus for securing an end of wire coiled onto a spool, whereby the last winding on the wire coil is taken up together with at least one preceding winding and connected thereto, after which the wire is cut between the point of connection and the wire feed apparatus.

According to the invention, said apparatus comprises the following means for connecting said windings to each other:

- means for increasing under tension the length of the windings to be connected to each other,
- means for keeping under tension the additional length of the windings to be connected to each other at the place where the connection is to be formed,
- means for making the connection between the windings while incorporating the additional length into the formed connection.

In particular, the apparatus according to the invention comprises means for increasing under tension the length of the windings to be connected to each other: these means consisting of two pins mounted perpendicularly onto an arm, which arm can be rotated in a plane perpendicular to the axis of the spool, whereby the center of rotation of the arm can be moved in said plane from a starting position to a point on the axis of the spool and said center of rotation can subsequently be moved along this axis in such a way that said pins cross the windings to be connected to each other, and also means for rotating the arm until a desired number of windings is carried on the pins.

The pins on said arm are first of all positioned at the right distance with respect to the circumference of the coil wound onto the spool. By the subsequent rotation of the arm, whereby the center of rotation lies on the produced part or the continuation of the spool axis, a desired number of windings is wound on the pins. The arm is rotated in the same direction as the spool during the winding process. The arm can for instance be rotated pneumatically, whereby the pneumatic cylinder has a length corresponding to a desired number of rotations of this arm. If required, an additional length of wire for the connection to be formed can be obtained by a slight clockwise rotation of the spool or by feeding an additional length of wire.

The apparatus according to the invention is further characterized in that the means for making the connection between the windings concerned while incorporating the additional length into the connection consisting of two clamp jaws hinging on a common axis, whereby one clamp jaw is provided with a conical protrusion and the other clamp jaw is provided with a corresponding recess, said protrusion fitting into said recess when the clamp jaws are closed, and that means are provided for rotating the closed clamping unit of jaws clamping around the windings to be attached, around an axis perpendicular to the axis of the spool onto which the wire has been coiled. This unit of the apparatus goes into operation when the additional length of wire has been formed by means of the pins. Two jaws hinging on a common axis are so positioned with respect to the wire held by the pins that a conical protrusion on one of the jaws is located between the windings held by the pins and the windings on the spool. Subsequently, the second jaw is closed against the first jaw, whereby the wire held by the pins, is gripped tightly. When the wire is thus firmly held, the pins used before for introducing the additional length of wire, can be retracted or removed.

The apparatus according to the invention further incorporates means for holding under tension the additional length of the windings to be connected at the place where the connection is to be made, whereby these means are formed by means of a sliding chuck, that presses the windings to be connected, while under tension, against the wire on the spool both upstream and downstream of the place of connection; thereby simultaneously closing the means for forming the connection by moving said sliding chuck from a starting position E to a position F in which the sliding chuck preferably lies against the wire coiled on the spool.

The sliding chuck presses the parts of the windings outside connection area to the surface of the wire coiled onto the spool both upstream and downstream of the clamp jaws holding the windings. All additional length of wire is now concentrated at the place of the clamp jaws holding the windings to be connected. When this stage has been reached, the clamp jaws are rotated around their axis in order to incorporate the additional length of wire into the connection thus formed between the windings.

The means described above for the connection of windings are advantageously put into action in a fixed, predetermined sequence and further means are present to control the action and movements of said connecting means in a programmed manner. Such means of control are widely available and are well-known to those skilled in the art. Such control means will therefore not be discussed in detail here.

The apparatus according to the invention therefore advantageously incorporates means for the programmed execution of the following steps with a stationary spool:

- moving the center of rotation of an arm on which pins are mounted so that the pins cross the windings to be connected to each other,
- rotating the arm until it carries a sufficient number of windings,
- moving the unit containing the clamp jaws until the conical protrusion on one of the clamp jaws is so positioned with respect to the windings carried on the pins that when the clamp jaws are closed, said protrusion is nearer to the axis of the spool than said windings.
- closing the clamp jaws by moving the sliding chuck towards the spool,
- moving the center of rotation of the arm in such a way that the pins no longer cross the windings to be interconnected,
- moving the sliding chuck further towards the spool to lie against the wire on the spool,
- rotating the closed clamp jaws until the additional length of wire has been incorporated into the connection thus formed,
- retracting the sliding chuck from the spool,
- opening the clamp jaws.

Such a programmatically controlled apparatus for securing the end of a wire coiled onto a spool to one or more preceding windings can be very advantageously incorporated in an installation for coiling wire onto a spool, said installation also comprising means to cut the wire at a predetermined point in time, to remove the fully coiled spool, to insert an empty spool and to secure wire to be coiled onto the empty spool.

The invention also relates to a spool containing wire coiled thereon whereby at least the last two windings have been connected to each other and whereby these windings have been connected to each other by using the apparatus according to the invention as described above.

Such a coil has the remarkable property, that the length of wire that has to be discarded on usage is minimal and is equal for all the formed coils.

BRIEF DESCRIPTION OF THE DRAWINGS

The invention will now be illustrated with reference to the drawing, wherein:

FIG. 1 is a side view of an installation for coiling wire, including an apparatus for forming a connection between the windings or for securing the windings according to the invention.

DETAILED DESCRIPTION OF THE INVENTION

Figure 7:
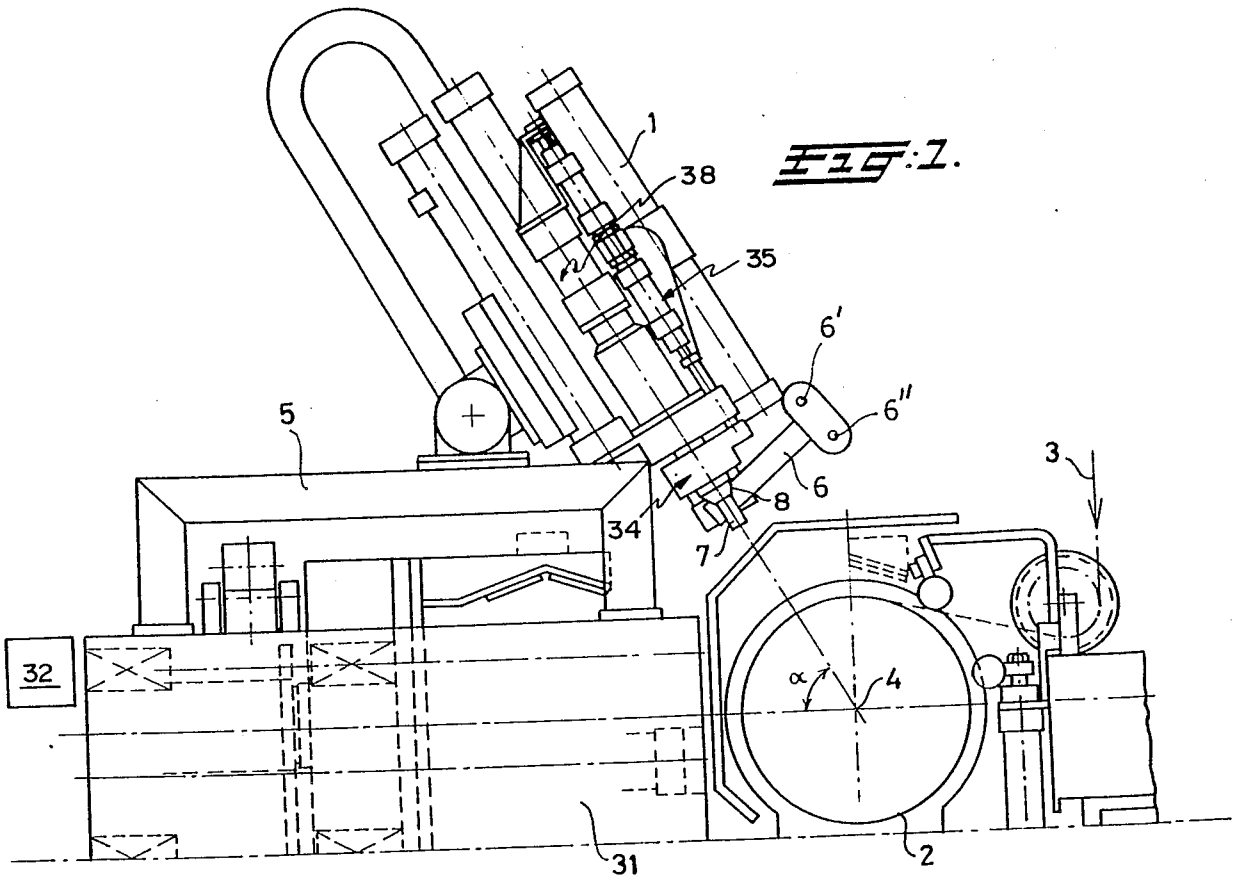

A side view of a wire coiling installation 31 is represented schematically in FIG. 1. It comprises an apparatus 1 for connecting windings to each other, whereby in the plane of FIG. 1 the axis of said apparatus 1 makes an angle (generally 30°) with a vertical axis intersecting the axis of the spool 2. The wire 3 is coiled onto the spool 2 in a per se known manner. The spool 2 rotates around the axis 4 during said coiling process. The apparatus 1 has been mounted onto the frame 5 in such a way, that the apparatus 1 can be shifted parallel to its longitudinal axis towards and away from the spool axis 4 and can also be shifted parallel to the spool axis. An arm 6 serves the purpose of increasing the length of the windings to be connected to each other. In order to carry out said operation, the center of rotation of the arm 6 must be moved to lie on the axis 4 of the spool 2. Then said center of rotation is shifted along the axis 4 until pins 6' and 6'' are opposite the wire coiled onto the spool. As will be indicated below, a predetermined number of windings will be elongated by means of the arm 6. By means of a unit 7, as will be explained below, the number of windings to be connected is gripped, whereupon the connecting operation is then executed is subsequent steps. The wire fed to the apparatus 1 is indicated by number 3.

Figure 2:
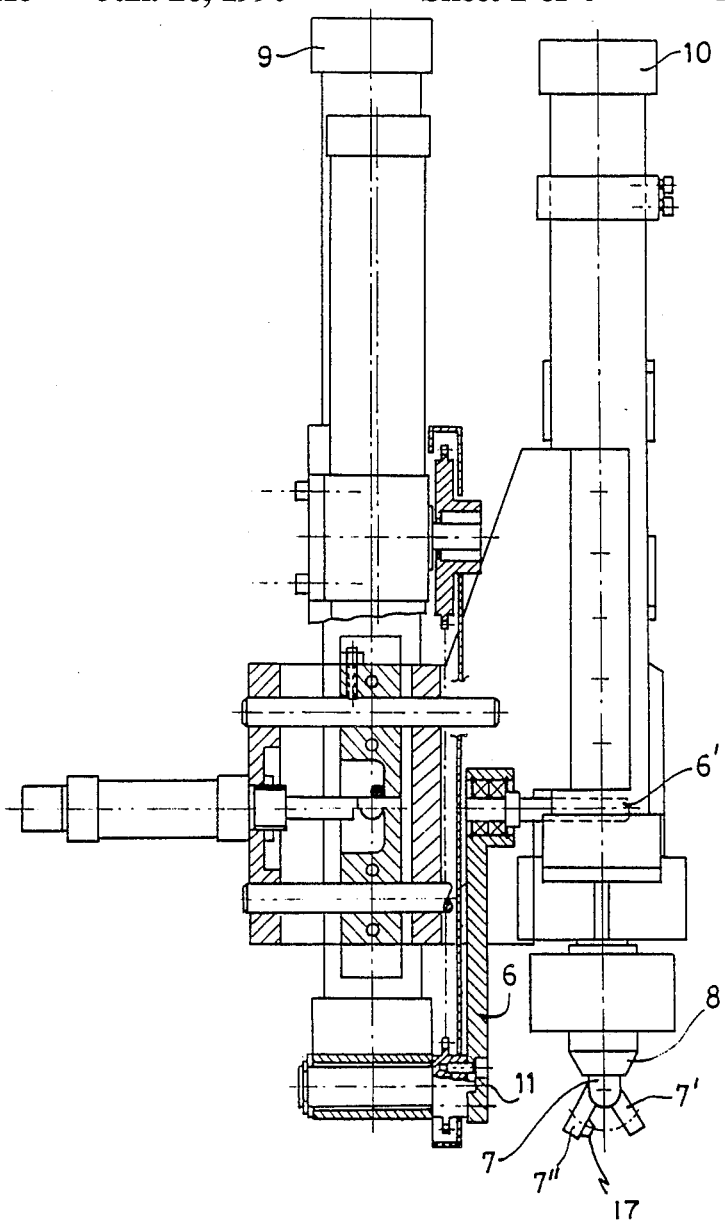
FIG. 2 shows in detail the means for the formation of the connection, whereby in this instance, the spool axis is parallel to the plane of the drawing.

Number 9 in FIG. 2 indicates that part of the apparatus, on which the arm 6 and its drive are mounted, whereas number 10 indicates the part of the apparatus for connecting the windings to each other.

Number 6 again shows (in FIG. 2) the arm with pin 6' (in view) and pin 6'' (out of view). Number 11 indicates the center of rotation of the arm. The part 10 for forming the connection between the windings consists of a unit 7 with subunits 7' and 7'', whereby this unit 7 serves to grip the windings which have been elongated by means of the arm 6 and pins 6' and 6''. To this end, the subunit 7'' comprising a conical protrusion grips under the windings supported by the pins 6' and 6'', whereupon the subunits 7' and 7'' are brought together or closed by means of a sliding chuck 8. As will be indicated below, the pins 6' and 6'' are removed or retracted after the subunits 7' and 7'' have been closed; whereas the element 8 preferably presses against the coil on the spool or against the wire coiled on the spool 2. As soon as said subunits 7' and 7'' are closed and pressure is exerted, the unit 7 gripping the windings is rotated around its vertical axis to attach or connect the windings to each other.

Figure 3A:
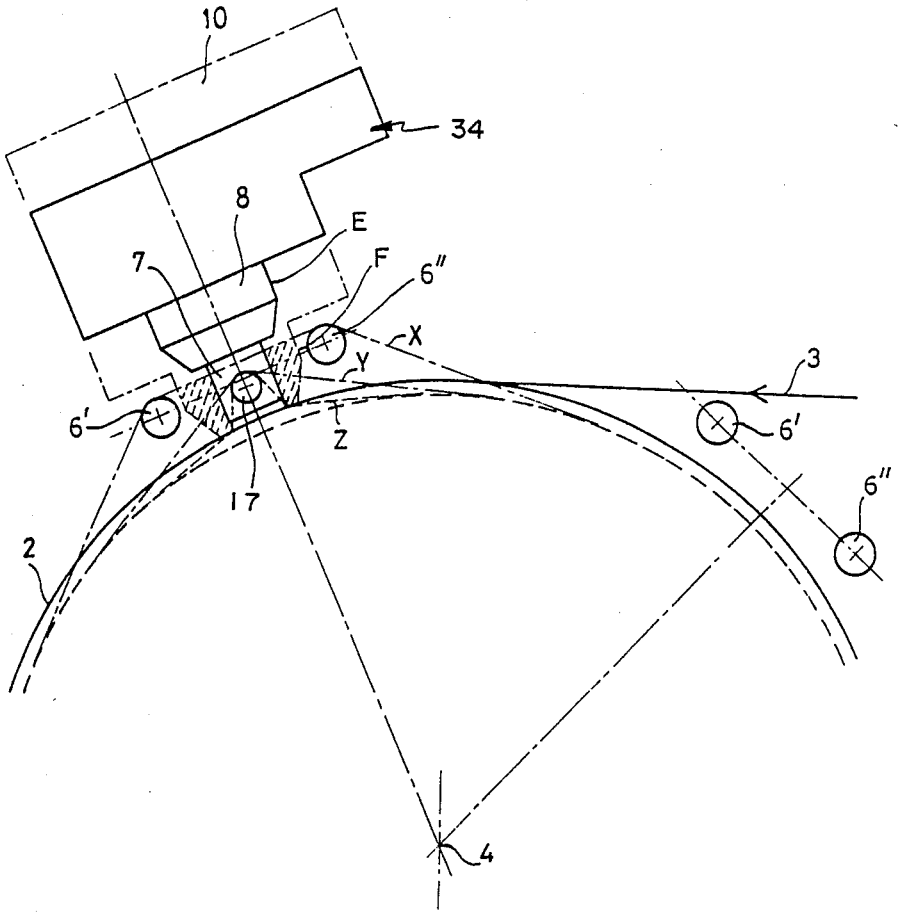
FIGS. 3A and 3B show views of the various important elements and their relative positions during the connecting or securing operation.

FIG. 3A represents on a larger scale the position of the wires during the various stages of the formation of the connection between the wires. On the right hand side, the wire 3 is shown being wound and still under tension. Between said wire 3 and the spool 2 the pins 6′ and 6″ have been drawn in their starting position. By rotating the arm 6 anti-clockwise, a predetermined number of windings will be mounted on the pins 6′ and 6″, while the spool 2 is stationary. If necessary, the spool 2 can be rotated slightly in the clockwise direction or a small amount of additional wire can be fed to obtain the desired additional length of wire in the windings to be connected or attached. The rotation of the arm 6 is stopped at a point where, as indicated in FIG. 2 and in FIG. 3A, the line connecting the centers of the pins 6′ and 6″ is perpendicular to the central axis of the part 10 and in addition intersects said central axis, whereby this part 10 is used to make the attachment or connection between the windings. Then the clamp jaws 7′ and 7″are closed around the windings to be connected to each other, whereby a conical protrusion 17 ensures that the windings are gripped by the jaws. After the jaws 7′ and 7″ have been closed, the pins 6′ and 6″ are removed, whereupon the sliding chuck 8 is moved towards the coil surface from position E to position F, as indicated in FIG. 3A. In FIG. 3A, X indicates the wire position when the windings are carried by the pins 6′ and 6″. Y indicates the situation when the windings have been gripped by the clamp jaws 7′ and 7″ and the pins 6′ and 6″ have been removed, whereas Z indicates the situation when the sliding chuck 8 has been moved towards the coil surface to press the windings against the wire coiled onto the spool 2. However, it is not necessary that the sliding chuck 8 lies against the wire coiled onto the spool 2.

Figure 3B:
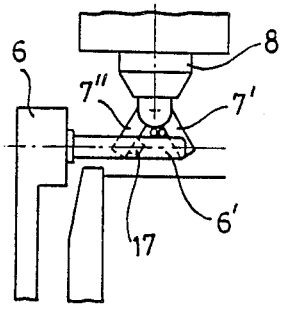

FIG. 3B illustrates once again, on enlarged scale, the relative position of the pins 6′ (in view) and 6″ (out of view) with respect to the subunits or clamp jaws 7′ and 7″.

Figure 4:
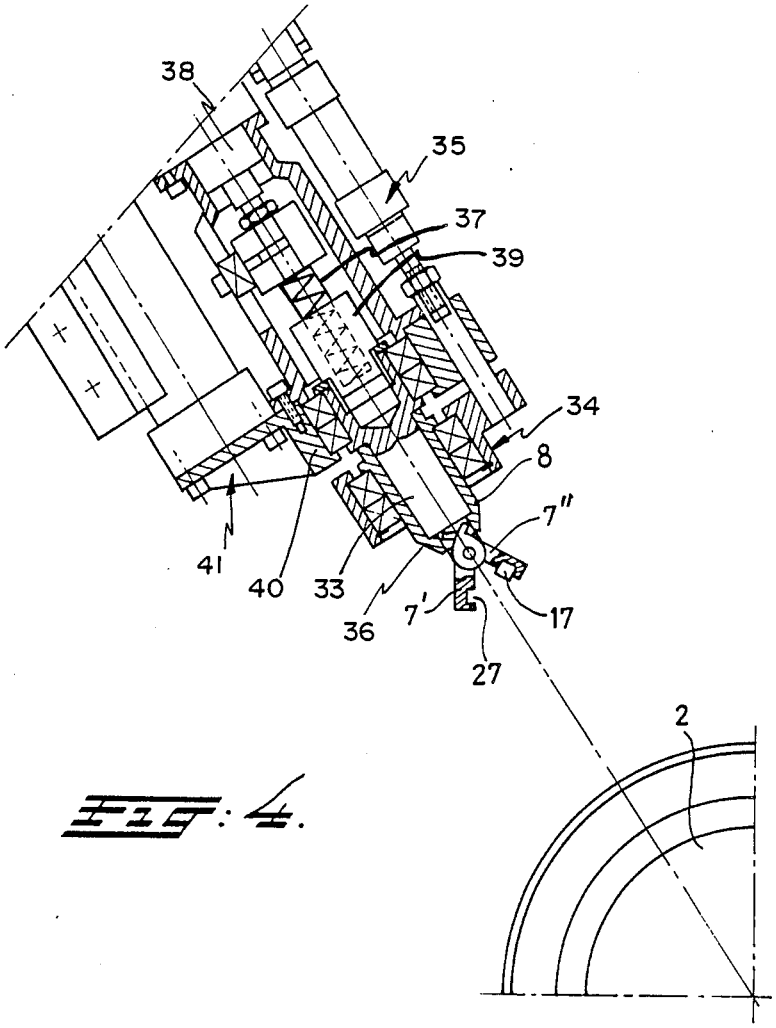
FIG. 4 shows in detail the part of the apparatus used to grip the windings to be connected to each other and to press these windings against the coil surface.

Finally, FIG. 4 shows details of the part 10 (as introduced in FIG. 2) which is used for connecting the windings to each other. It shows the clamp jaws 7′ and 7″ with the conical protrusion 17 and the recess 27, used for gripping the windings to be attached. The sliding chuck 8 fits closely around the clamp jaws 7′ and 7″ in order to make the subunits 17 and 27 fit into each other. The conical protrusion 17 on clamp jaw 7′ is so shaped to ensure the easy and certain release of the wire loop that is formed when the connection or attachment is made, when the clamp jaws 7′ and 7″ are opened again.

A person skilled in the art will understand the operation of the sliding chuck 8 relative to the opening and closing and rotation of the jaws 7′ and 7″, as best shown in FIG. 4. Shaft 33 is secured to jaws 7′ and 7″. Element 34 is operably associated with the chuck 8 and moves with it, as best shown in FIG. 3A and 4. The element 34 is operably associated with a piston/cylinder assembly 35. The sliding chuck 8 moves between a retracted position E and an extended position F, as best shown in FIGS. 3A and 4. The piston/cylinder assembly 35 drives the chuck 8 between its retracted position E to its extended position F and back to its retracted position E. One skilled in the art will understand that any drive means can be used to move the chuck 8 between its two positions. As the chuck moves between positions E and F, the shaft 33 and jaws 7′ and 7″ remain stationary relative to the chuck 8. Therefore, when the chuck 8 moves to its extended position F, the forward portion 36 of the chuck 8 forces the jaws 7′ and 7″ to close. When the chuck 8 moves back to its retracted position E from its extended position F, the jaws 7′ and 7″ open up. One skilled in the art will understand that, as the chuck 8 moves toward its extended position F, the chuck 8 will cause the jaws 7′ and 7″ to close, thereby gripping the windings of wire, and the forward portion 36 of the chuck 8 will force the portion of the wires adjacent to each side of the gripped wires downwardly toward the spool, as best shown in FIG. 3A.

Means for rotating the jaws 7′ and 7″ includes a screw 37 which is driven downwardly by a piston/cylinder assembly 38, causing the screw 37 top thread itself into block 39 which has a cooperating inner thread. The downward action of the screw 37 causes the block 39 to rotate as their threads engage each other. The block 39 is secured to the shaft 33 which is in turn secured to the jaws 7′ and 7″. A person skilled in the art will understand that the downward motion of the screw 37 will cause the jaws 7′ and 7″. A person skilled in the art will understand that the downward motion of the screw 37 will cause the jaws 7′ and 7″ to rotate, thereby causing the twisting of the gripped wires. Bearing assembly 40 permits ease of rotation of the block 39 relative to support member 41.

In the apparatus according to the invention as described above, the sliding chuck 8 preferably presses against the spool 2 provided with the coiled wire. The additional length of wire in the windings to be connected, obtained by using the pins 6′ and 6″, is held under tension, for instance by using the tension between the spool 2 and the wire drawing machine. It is also possible to replace the pins 6′ and 6″ by a single pin 6 and to use this single pin to provide the additional length in the windings to be attached to each other.

Control means 32 controls the action and movements of the apparatus 1 in a programmed manner.

It is clear that within the scope of the invention, many variations can be carried out. For instance, when the spool 2 is clamped between two clamping plates or supported at both ends instead of being supported only in one place or at one end; then it is not always possible to use a real arm 6, whereby its real center of rotation 11 lies on the continuation or produced part of the axis 4 of the spool 2 for increasing the length of the windings to be connected to each other. However, it is then always possible to use a small arm 6 with pins 6′ and 6″, whereby the imaginary continuation or produced part of the arm 6 then fulfills the same function as the real arm 6 in the FIGS. 1–4.

The description given above of the apparatus according to the invention is based on the assumption that the various movements and actions are effected by pneumatic or hydraulic means. It is, of course, also possible to use other sources of power for driving the various parts, such as for instance, electrical power.

We claim:

1. A method for securing the last winding to at least the preceding winding of a wire coiled onto a spool from a wire feeding machine, said method comprising the steps of:

(a) providing means for engaging a first portion of the last winding of a coil in a spool, said first portion being disposed between the spool and a wire feeding apparatus;

(b) positioning said engaging means over the spool and below said first portion of the last winding of the coil;

(c) moving said engaging means underneath said last winding at least one complete revolution around the spool in the direction of rotation of the spool during a winding process so that a second portion of said last winding and an adjacent portion of a preceding winding are caused to be disposed over said engaging means at a distance over the spool;
(d) gripping said second and adjacent portions;
(e) removing said engaging means underneath said portions; and
(f) securing said second and adjacent portions together.

2. A method as in claim 1, wherein;
(a) said step of moving includes causing said engaging means to trace a circle about an axis of rotation of the spool.

3. A method as in claim 1 wherein:
(a) said securing includes the step of twisting said second and adjacent portions together.

4. A method as in claim 1, wherein:
(a) said gripping includes applying tension to said last winding and said preceding winding.

5. A method as in claim 1, and including the step of:
(a) rotating the spool opposite the direction of movement of said engaging means.

6. A method as in claim 1 and including the step of:
(a) feeding an additional amount of wire onto the spool.

7. An apparatus for securing the last winding to at least the preceding winding of a wire coiled onto a spool from a wire feeding machine, said apparatus comprising:
(a) means for raising above a spool a first portion of the last winding and an adjacent portion of at least a preceding winding of a coil in the spool;
(b) means for gripping said first and adjacent portions;
(c) means for forcing adjacent portions of the wire on each side of the gripped portions downwardly towards the spool; and
(d) means for rotating said gripping means for securing said first and adjacent portions to each other.

8. An apparatus as in claim 7, wherein:
(a) said raising means includes pin means for engaging a second portion of the last winding of the coil in the spool, said second portion being disposed between the spool and a wire feeding apparatus;
(b) said pin means being positionable over the spool and below said second portion of the last winding of the coil; and
(c) said raising means includes means for moving said pin means underneath said last winding at least one complete revolution around the spool in the direction of rotation of the spool during a winding process so that said first portion of said last winding and said adjacent portion of said at least a preceding winding are caused to be disposed over said pin means at a distance over the spool.

9. An apparatus as in claim 8 wherein:
(a) said means for moving includes an arm means having an axis of rotation substantially coincident with the axis of the spool.

10. An apparatus as in claim 9 wherein:
(a) said pair of pins are disposed on said arm means.

11. An apparatus as in claim 9, wherein:
(a) said axis of rotation of said arm means is movable along a first direction substantially coincident with the axis of the spool and along a second direction transverse to the axis of the spool, whereby said pair of pins are positioned underneath said second portion of the last winding.

12. An apparatus as in claim 7 wherein:
(a) said pin means comprises a pair of spaced apart pins disposed parallel to a longitudinal axis of the spool.

13. An apparatus as in claim 7, wherein:
(a) said gripping means includes a pair of cooperating clamp jaws positionable between open and closed positions and pivotally connected to each other.

14. An apparatus as in claim 13 wherein:
(a) one of said clamp jaws includes a conical protrusion; and
(b) the other one of said clamp jaws includes a cooperating recess for accepting said conical protrusion when said clamp jaws are in the closed position.

15. An apparatus as in claim 7 wherein:
(a) said forcing means includes chuck means slidable over said clamp jaws for forcing said wire portions adjacent to the gripped portions toward the spool.

16. An apparatus as in claim 15 wherein:
(a) said chuck means has a first position wherein said clamp jaws are outside said chuck means, thereby permitting said clamp jaws to be in the open position, and a second position wherein said clamp jaws are disposed within said chuck means, thereby causing said clamp jaws to be in the closed position.

17. An apparatus, as in claim 7 and including:
(a) means for controlling the operation of the apparatus in a predetermined sequence.

18. A method for securing the last winding to at least the preceding winding of a wire coiled onto a spool from a wire feeding machine, said method comprising the steps of:
(a) providing an arm means for carrying a pair of pins disposed parallel to an axis of a spool, said arm means having an axis of rotation;
(b) moving said axis of rotation of said arm means to a point along the axis of the spool so that said pins are positioned underneath a portion of the last winding disposed between the spool and the wire feeding machine;
(c) rotating said arm means about its axis of rotation in the direction of rotation of the spool during a winding process so that at least two windings are disposed over said pins at a distance above the spool;
(d) providing a first clamp jaw having a conical protrusion and a second clamp jaw pivotally secured to said first clamp jaw and having a depression for accepting said conical protrusion when said first and second clamp jaws are closed;
(e) positioning said first and second clamp jaws over the at least two windings disposed over said pins so that said conical protrusion is positioned between the spool and the windings;
(f) sliding a chuck over said first and second clamp jaws for closing said clamp jaws;
(g) withdrawing said pins away from the windings;
(h) sliding said chuck further toward the spool until said chuck engages the wire in the spool;
(i) rotating said clamp jaws until the wire has been twisted together;
(j) retracting said chuck; and
(k) opening said clamp jaws.

19. A method as in claim 18 and including the step of:

(a) cutting the wire at a point between the joined portions and the wire feeding machine.

20. A method for loading a wire onto a spool, comprising the steps of:

(a) feeding a wire onto a rotating empty spool;

(b) stopping the rotation of the spool after a predetermined amount of wire has been coiled onto the spool;

(c) providing means for engaging a first portion of the last winding of the coil in the spool, said first portion being disposed between the spool and a wire feeding apparatus;

(d) positioning said engaging means over the spool and below a first portion of the last winding of the coil;

(e) moving said engaging means underneath said last winding at least one complete revolution around the spool in the direction of rotation of the spool so that a second portion of said last winding and an adjacent portion of a preceding winding are caused to be disposed over said engaging means over the spool;

(f) gripping said second and adjacent portions;

(g) removing said engaging means underneath said portions;

(h) securing said second and adjacent portions together; and (i) cutting said last winding between the joined portions and the wire feeding machine.

* * * * *